US008281764B2

(12) United States Patent
Gurler

(10) Patent No.: US 8,281,764 B2
(45) Date of Patent: Oct. 9, 2012

(54) HALF CYCLE ECCENTRIC CRANK-SHAFTED ENGINE

(76) Inventor: Onur Gurler, Rutherford, NJ (US)

( * ) Notice: Subject to any disclaimer, the term of this patent is extended or adjusted under 35 U.S.C. 154(b) by 652 days.

(21) Appl. No.: 12/456,974

(22) Filed: Jun. 25, 2009

(65) Prior Publication Data

US 2010/0326390 A1 Dec. 30, 2010

(51) Int. Cl.
*F02B 75/32* (2006.01)

(52) U.S. Cl. ..... 123/197.4; 74/595

(58) Field of Classification Search ..... 123/197.1, 123/197.3, 197.4; 74/595, 600–604
See application file for complete search history.

(56) References Cited

U.S. PATENT DOCUMENTS

| | | | |
|---|---|---|---|
| 1,209,708 | A | 12/1916 | Houlehan |
| 1,574,573 | A | 2/1926 | Hale |
| 1,728,363 | A | 9/1929 | Ritenhour |
| 1,748,443 | A | 2/1930 | Dawson |
| 1,978,058 | A | 10/1934 | Peterson |
| 2,006,498 | A | 7/1935 | Dasset |
| 2,060,221 | A | 11/1936 | King |
| 2,151,853 | A | 3/1939 | Jonville et al. |
| 2,165,791 | A | 7/1939 | Farrell |
| 2,287,472 | A | 6/1942 | Eby |
| 2,340,010 | A | 1/1944 | Miller |
| 2,528,386 | A | 10/1950 | Napper |
| 3,189,178 | A | 6/1965 | Callesson et al. |
| 3,895,614 | A | 7/1975 | Bailey |
| 4,044,629 | A | 8/1977 | Clarke |
| 4,211,190 | A | 7/1980 | Indech |
| 4,266,443 | A | 5/1981 | McWhorter |
| 4,406,256 | A | 9/1983 | Akkerman |
| 4,437,438 | A | 3/1984 | Mederer |
| 4,466,403 | A | 8/1984 | Menton |
| 4,467,756 | A | 8/1984 | McWhorter |
| 4,526,141 | A | 7/1985 | Catchpole |
| 4,712,518 | A | 12/1987 | Johnson |
| 4,777,845 | A | 10/1988 | Miller |
| 4,803,964 | A | 2/1989 | Kurek et al. |

(Continued)

FOREIGN PATENT DOCUMENTS

KR 2001096725 A * 11/2001

(Continued)

OTHER PUBLICATIONS

International Search Report, PCT/US10/37397, dated Jan. 3, 2011.

*Primary Examiner* — Noah Kamen
(74) *Attorney, Agent, or Firm* — Lerner, David, Littenberg, Krumholz & Mentlik, LLP

(57) ABSTRACT

An internal combustion engine having a piston reciprocating in a cylinder between TDC and BDC positions to influence a drive shaft. The drive shaft is associated with an expandable piston rod extension which in turn attaches to a piston rod to connect the piston with the drive shaft. The piston rod extension's length may increase and decrease in accordance with the angular position of the drive shaft. The increasing and decreasing length is governed by a guide pin which travels within a channel formed by a portion of the engine block. Increasing the length of the piston rod extension during the power phase of the engine increases the available torque of the engine without any alteration of the displacement. The assembly may also include a counterweight, which itself may travel along an eccentric path generally equal and opposite to the eccentric path along which the piston rod extension guide travels.

24 Claims, 6 Drawing Sheets

U.S. PATENT DOCUMENTS

| | | | |
|---|---|---|---|
| 4,934,344 | A | 6/1990 | Perr |
| 4,966,043 | A | 10/1990 | Frey |
| 5,060,603 | A | 10/1991 | Williams |
| 5,165,368 | A | 11/1992 | Schechter |
| 5,167,208 | A | 12/1992 | Rasiah |
| 5,215,045 | A | 6/1993 | Vadnjal |
| 5,239,958 | A | 8/1993 | Booher |
| 5,297,448 | A | 3/1994 | Galvin |
| 5,299,537 | A | 4/1994 | Thompson |
| 5,394,839 | A | 3/1995 | Haneda |
| 5,398,652 | A | 3/1995 | Jackson |
| 5,544,627 | A | 8/1996 | Terziev et al. |
| 5,647,308 | A | 7/1997 | Biagini |
| 5,711,267 | A | 1/1998 | Williams |
| 5,890,465 | A | 4/1999 | Williams |
| 5,908,014 | A | 6/1999 | Leithinger |
| 5,927,236 | A | 7/1999 | Gonzalez |
| 6,202,622 | B1 | 3/2001 | Raquiza, Jr. |
| 6,453,869 | B1 | 9/2002 | Moore |

FOREIGN PATENT DOCUMENTS

| | | | |
|---|---|---|---|
| WO | 8801684 | A1 | 3/1988 |

* cited by examiner

HALF CYCLE ECCENTRIC CRANK-SHAFTED ENGINE

BACKGROUND OF THE INVENTION

The present invention relates broadly to internal combustion engines, and more particularly to an arrangement for varying the effective length of the drive shaft moment arm of the crank shaft assembly to maximize torque output for a given combustion chamber volume.

Internal combustion engines were invented in the 1850's and were first placed in practical use by Nicolaus Otto sometime thereafter. In 1885, the first automobile to utilize an internal combustion engine was built by Karl Benz, who received a patent for his invention in 1886. Production vehicles based on this design were first sold in 1888, and the automobile industry was borne.

Since then, automobile manufactures have developed their engines with an emphasis on producing greater power and durability. In the 1950's, the trend was to use large engines and to maximize those engines for greatest (higher) torque, particularly in the United States and other areas outside of Europe. However, these engines have proven to be terribly inefficient.

This was particularly problematic in the 1970's during gasoline rationing attendant to the 1973 oil crisis and 1979 energy crisis. From approximately that point forward, automobile manufacturers and legislatures began focusing more attention to engine efficiency and initiated greater emphasis on designing more powerful engines that use less fuel.

Early advances were in the form of fuel injection systems which developed to efficiently utilize every ounce of available gasoline. These injection systems featured pumps adapted to push fuel under pressure through a small orifice, atomizing the gasoline particles, and replaced the conventional carburetor which relied on vacuum created by the air intake to supply fuel. With the advance of fuel injection, fuel input could be more accurately regulated. By the late 1980's, virtually all new automobiles featured fuel injection rather than carburetors.

Material science advances also permitted more fuel efficient engine designs. Such designs featured more durable wearing components, such as valves, and lighter components, such as alloy pistons. These advances improved engine efficiency drastically and permitted use of faster reciprocation and overhead cams. Nevertheless, the basic operation of the engine did not change.

In this regard, it is well known that internal combustion gasoline engines utilize a mixture of air and gasoline which in conjunction with a spark ignite to produce power over a stroke pattern, often identified as intake, compression, combustion, and exhaust. In these engines, the piston(s) reciprocate between a top dead center (TDC) position and a bottom dead center (BDC) position. The distance the piston travels between the TDC and BDC positions is referred to as a stroke length.

A four stroke engine requires four piston strokes, or two full revolutions of the drive shaft, to complete one cycle while a two stroke engine requires only two piston strokes, or one full revolution of the drive shaft to completely one cycle. For purposes of this invention, the engine may be either two or four stroke. However, the discussion will generally focus on a four stroke engine as such are more popular than the increasingly unpopular two stroke variety.

During the first stroke of a four stroke engine, the piston recedes from TDC to BDC and the intake valve (or valves, as the case may be) opens to permit air into the combustion chamber, which is mixed with an appropriate amount of gasoline through the fuel injector. In the second stroke, the intake valve closes and the piston compresses the mixture as it moves back to TDC. Combustion starts as the piston passes TDC in the third stroke in response to a spark produced by the spark plug. As the reaction starts, atom by atom the temperature and pressure of the mixture raises drastically. Reaction takes place in a very fast manner, and it may be observed as an explosion. As the piston passes TDC a few drive shaft degrees, most of the fuel inside the chamber has been consumed and the highest temperature and pressure has been achieved. The attendant increase in volume as the piston moves toward BDC causes the gas to start loosing its pressure while the crank shaft assembly keeps moving to a higher moment arm position. The pressure of the gas influences a moment to the drive shaft with the help of the piston and the connecting rod to produce power. As the piston passes the BDC position, the exhaust valve (or valves, as the case may be) opens and exhausted gases leave the combustion chamber, thus completing the fourth cycle. As the piston again passes through TDC in the fourth cycle, the first cycle begins again.

Taking a non-adiabatic view, the conventional engine of this type includes two parameters that influence only torque, one is the pressure (P(y)) and the other is the length of the moment arm. The following equation mathematically describes the physical parameters of the engine.

Radius=moment arm=piston rod length=stroke length/2

And the torque of a motor is defined as:

$T(x,y)=P(y)*A_{piston}*x$ at a given (x,y) point of the piston rod pin center line.

x is defined as $R*\sin(\theta)$, where $\theta$ is the angle between center of piston rod pin and the 0 point.

As more fuel and air is delivered into the cylinders, P(y) increases automatically. However, to manufacture an efficient engine, one endeavors to use less fuel for a given power output. Thus, it would be advantageous to devise an engine having increased torque while at the same time consuming less fuel.

BRIEF SUMMARY OF THE INVENTION

The present invention achieves this result and overcomes the shortcomings of the prior art by increasing the moment arm length only during the power and intake strokes of the engine cycle while returning the crank shaft assembly moment arm to its normal length during the remaining strokes so as to increase torque during the power phase but not to increase the overall swept cylinder volume.

In accordance with one aspect of the present invention, there is provided an internal combustion engine having an engine block forming at least one cylinder with a central axis, a piston adapted to reciprocate linearly within the at least one cylinder along the central axis between a top dead center position and a bottom dead center position, a crank shaft assembly mounted within the engine block, the crank shaft assembly including a drive shaft with a drive shaft axis and a hollow piston rod leg base, a piston rod extension associated with the piston rod leg base, the piston rod extension having a first end adapted to travel in a reciprocating manner from a retracted position to an extended position, the first end being further within the hollow piston rod leg base in the retracted position than in the extended position, and a second end exterior to the hollow piston rod leg base, the second end including a guide, a piston rod having a first end pivotally connected to the piston and a second end pivotally connected to the second end of the piston rod extension, and a guide channel associated with the engine block, the guide channel eccentrically circumscribing the drive shaft axis. During rotation of the drive shaft, the piston reciprocates between its top dead center and bottom dead center positions, and the guide travels along the guide channel to influence the second end of the piston rod extension between its retracted position as the piston moves from a position substantially at top dead center to its extended position when the piston is approximately half way between its top dead center and bottom dead center positions.

If so provided, the guide channel may be arranged such that the piston rod extension is substantially in its retracted position at the piston's top dead center and bottom dead center positions. The guide channel may be arranged such that the piston rod extension is substantially in its retracted position as the piston travels from the bottom dead center position to the top dead center position.

The guide may be a guide pin.

The guide may be configured as two guides and the guide channel may be configured as two guide channels.

The engine may include a counterweight. If so provided, the guide may be a first guide and the channel may be a first channel, the counterweight further having a second guide and the engine block further having a second guide channel, the second guide and second guide channel influencing movement of the counterweight. The counterweight may be connected to the drive shaft along a counterweight channel, the counterweight channel permitting the counterweight to shift from a first position relative to the drive shaft to a second position relative to the drive shaft, the center of mass of the counterweight being closer to the drive shaft in the first position than in the second position, the shaft being controlled by the second guide channel and second guide. The counterweight may move between its first position and its second position to substantially offset any imbalance created by movement of the piston rod extension from its retracted position and its extended position or from its extended position to its retracted position.

The engine block may be formed from at least two components. If so formed, the guide channel may be formed partially within each of the at least two components.

The engine may further include a plate attached to the engine block, wherein the guide channel is formed in the plate. If so formed, the plate may be replaceable.

The hollow piston rod leg base and the piston rod extension may form a telescoping assembly.

The engine may further include an air derivation hole associated with the hollow piston rod leg base, the hollow drive shaft, or both.

In accordance with further aspects of the invention, an internal combustion engine may include an engine block forming a cylinder with a central axis, a piston adapted to reciprocate linearly within the cylinder along the central axis between a top dead center position and a bottom dead center position, a crank shaft assembly mounted within the engine block, the crank shaft assembly including a drive shaft with a drive shaft axis and a piston rod leg base, a piston rod extension associated with the piston rod leg base, the piston rod extension having a first end adapted to travel in a reciprocating manner from a retracted position to an extended position, the first end being closer to the drive shaft in the retracted position than in the extended position, and a second end exterior to the piston rod leg base, the second end including a guide, a piston rod having a first end pivotally connected to the piston and a second end pivotally connected to the second end of the piston rod extension, and a guide channel associated with the engine block, the guide channel eccentrically circumscribing the drive shaft axis. During rotation of the drive shaft, the piston reciprocates between its top dead center and bottom dead center positions, the guide traveling along the guide channel to influence the piston rod extension between its retracted position as the piston moves from a position substantially at top dead center to its extended position when the piston is approximately half way between its top dead center and bottom dead center positions.

The piston rod leg base may be a pair of piston rod legs. The piston rod extension may reciprocate between the pair of piston rod legs.

The guide may be a pair of guide pins and the guide channel may be a pair of guide channels, the guides adapted to fit within the guide channels.

The engine may include an air derivation hole associated with the piston rod leg base, the hollow drive shaft, or both.

In accordance with still further aspects of the present invention, a crank shaft assembly may have a drive shaft with a drive shaft axis and a hollow piston rod leg base, and a piston rod extension associated with the piston rod leg base, the piston rod extension having a first end adapted to travel in a reciprocating manner from a retracted position to an extended position, the first end being further within the hollow piston rod leg base in the retracted position than in the extended position, and a second end exterior to the hollow piston rod leg base, where the drive shaft is adapted for use in an engine such that the drive shaft may rotate about the drive shaft axis and, the second end of the piston rod extension, when attached to a piston through a piston rod, may cause the piston to reciprocate within the engine as the piston rod extension goes from the retracted position to the extended position and back to the retracted position.

The crank shaft assembly may further include a counterweight.

BRIEF DESCRIPTION OF THE DRAWINGS

The subject matter regarded as the invention is particularly pointed out and distinctly claimed in the concluding portion of the specification. The invention, however, both as to organization and method of operation, together with the features, objects, and advantages thereof, may best be understood by reference to the following detailed description when read with the accompanying drawings in which:

DETAILED DESCRIPTION

Figures 1, 2, 3:
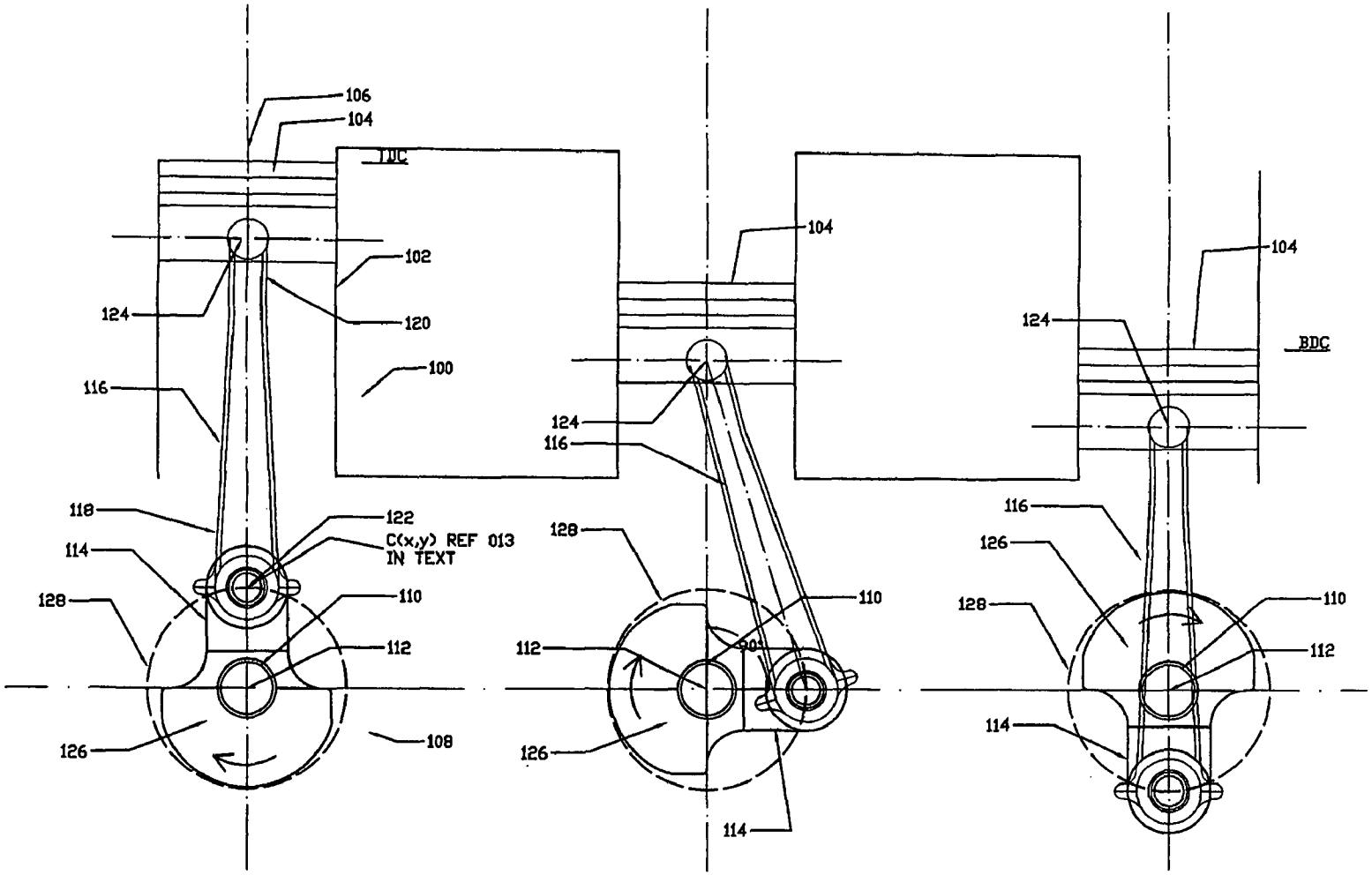
FIG 1 PRIOR ART
FIG 2 PRIOR ART
FIG 3 PRIOR ART
FIG. 1 is a partial cross-sectional view of certain internal components of a conventional gasoline engine in the TDC position.
FIG. 2 is a is a partial cross-sectional view of certain internal components of a conventional gasoline engine in a position between TDC and BDC.
FIG. 3 is a partial cross-sectional view of certain internal components of a conventional gasoline engine in the BDC position.

In the following are described the preferred embodiments of the half cycle eccentric crank-shafted engine in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Referring to the drawings, and prior to addressing the preferred embodiments of the invention, reference is drawn to FIG. 1 which depicts a partial cross-sectional view of certain components of a conventional engine, such as a four stroke gasoline engine. AS shown, the engine comprises an engine block 100 within which a cylinder 102 is cast or otherwise provided. The cylinder 102 houses a piston 104 which travels in a reciprocating manner along a centerline 106 of the cylinder 102. Of course, although shown in a generally vertical orientation in FIG. 1, it is well known that the cylinder 102 may be canted toward one side or the other depending on the application. For example, in a typical automobile application of a V-style engine, such as a V-6, banks of cylinders may be canted outwardly relative to each other. A crank shaft assembly 108 is mounted below the cylinder 102 in the conventional engine shown in FIG. 1.

The crank shaft assembly generally includes a drive shaft 110, which in the view of FIG. 1 is shown to extend into and out of the view along a drive shaft axis 112. Fixedly attached to the drive shaft 110 is a piston rod leg 114. As the drive shaft 110 rotates about the drive shaft axis 112, which for purposes of this disclosure will be represented in a clockwise orientation, the piston rod leg 114 also rotates, typically in a circular manner. This rotation drives a piston rod 116 which is pivotally connected at a first end 118 to the piston rod leg 114 and at a second end 120 to the piston 104. These connections are generally made through pins, 122, 124.

Many conventional engines also include counterweights 126 mounted to the drive shaft 110 in such a manner as to offset the imbalance which would otherwise be created by the offset connection of the piston rod leg 114 to the piston rod 116.

As a result of the linkage of the piston rod leg 114 to the piston rod 116, rotational movement of the drive shaft 110 is converted to linear movement, driving the piston between its TDC position, where it is farthest from the drive shaft 110, and its BDC position, where it is closest to the drive shaft. The TDC position is shown in FIG. 1 and the BDC position is shown in FIG. 3, with an intermediary position shown in FIG. 2.

It will be appreciated that in moving through these positions, the pin 122 rotates around a circular path 128 as the piston rod leg 114 is essentially of constant length. It is noted that the counterweight 126 moves through a similar circular path, typically of an equal or smaller diameter, but in this case also shown as path 128 as being equal.

The present invention contemplates altering the circular path 128 of at least pin 122 such that upon downward movement of the piston 104 in the power stroke, the so-called third stroke of a four stroke engine, the piston rod leg 114 is effectively lengthened to increase the length of the moment arm acting on the drive shaft 110. Comparatively, it will be appreciated that a longer moment arm will impart more torque to the drive shaft 110 for a given power pulse than a shorter moment arm. Thus, an engine which does not change overall capacity can produce more torque simply by increasing the length of the moment arm during the power stroke of the engine cycle.

Figure 4:
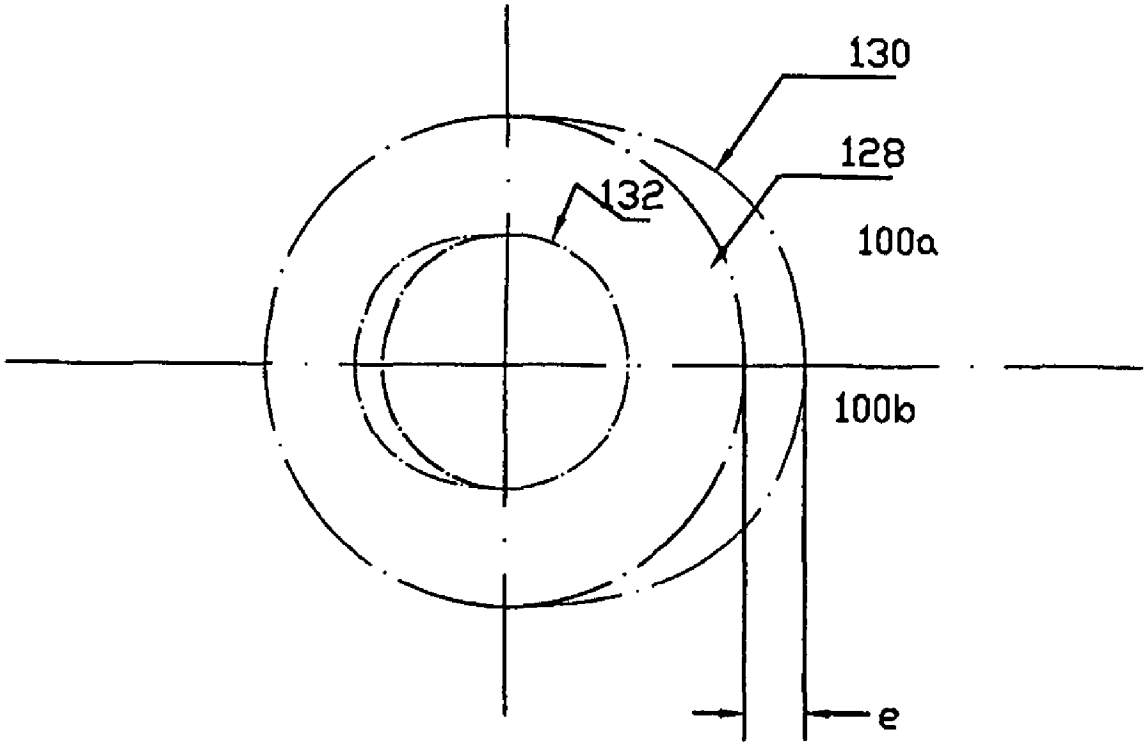
FIG. 4 is a representation of an eccentric path of the guide channel in accordance with certain embodiments of the present invention in comparison to a conventional circular path.

The present invention provides the ability to do so. As shown in FIG. 4, the circular path 128 of the conventional pin 122 connecting the piston rod 116 to the piston rod leg 114 is replaced by an eccentric path 130. In addition, if so provided, the counterweight 126 may also follow an eccentric path 132.

The eccentric paths may be represented as second, third, or fourth degree equations depending on design- considerations. A second degree equation curve is more closely related to the circular curvature of a conventional engine, and represents a conservative approach to engine design and manufacture in accordance with these teachings. With the help of equation parameters, the starting, intermediate, and finishing slopes may be modified. Third and fourth degree equations are deeper in the body of the curve and may deliver more output torque than second degree curves. Here, the beginning of the starting curvature must be horizontal, while the end of the finish curvature must be vertical. Curvatures must also be modeled to accommodate the desired percentage of eccentricity, which will be discussed below.

Figure 5:
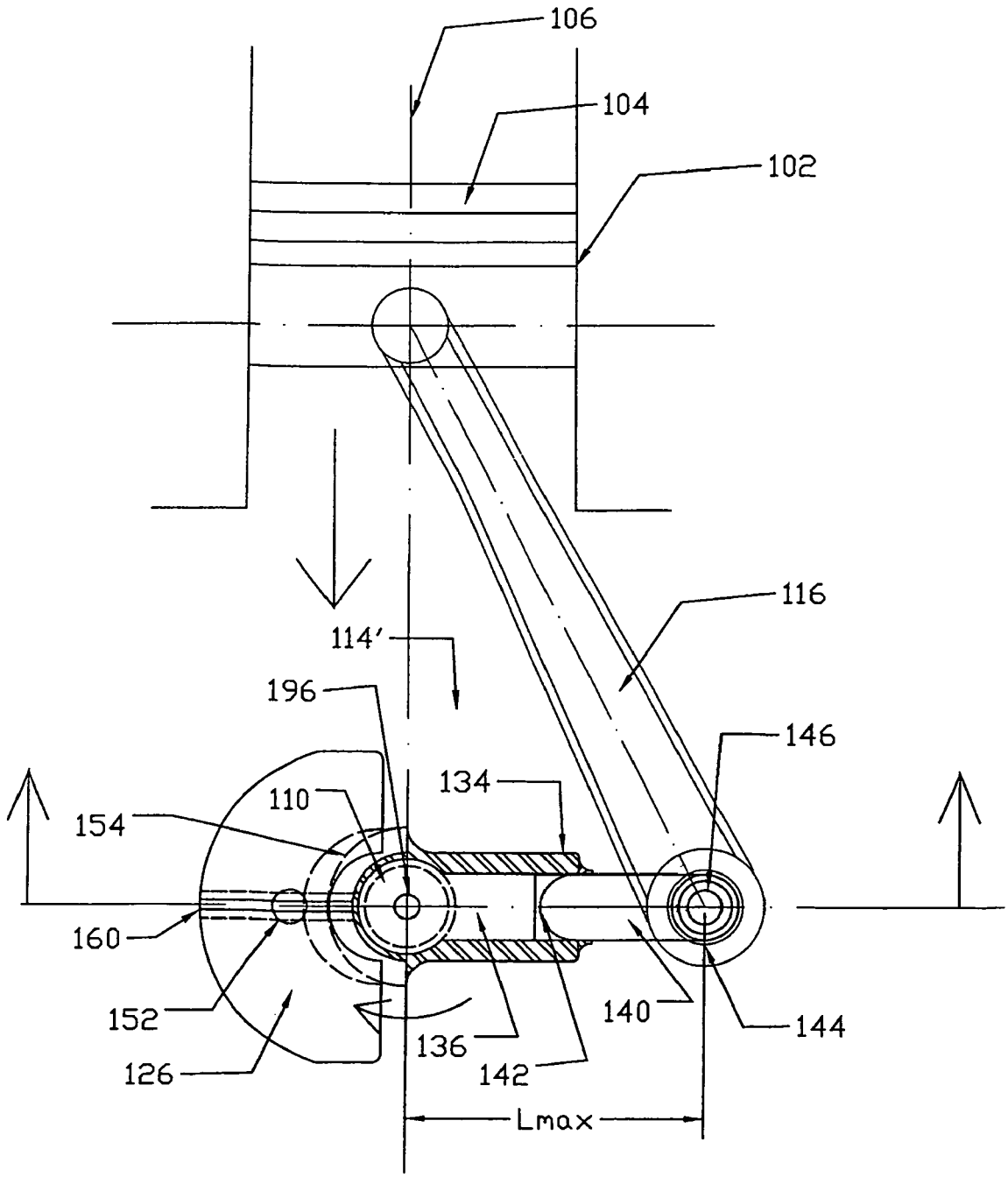
FIG. 5 is a partial cross-sectional view of a piston rod leg and associated components in accordance with one embodiment of the present invention, the piston rod leg in its longest configuration at a position between TDC and BDC.

In order to follow an eccentric path, the piston rod leg 114 may be formed from a plurality of components which allow the piston rod leg to expand or telescope in length. An example of such a piston rod leg is shown in FIG. 5. In this embodiment, the piston rod leg 114' is formed from a hollow piston rod leg base 134 which includes a cavity 136, a cross-section of which is shown in FIG. 5. A piston rod extension 140 may be fitted such that a first end 142 reciprocates within the cavity 136 of the piston rod leg base 134 while a second end 144 remains exterior thereto. Together, the piston rod leg base 134 and piston rod extension 140 form a rigid telescopic assembly. The second end 144 may be connected to an otherwise conventional piston rod 116, which is in turn connected to an otherwise conventional piston 104 within an otherwise conventional cylinder 102 (although their mechanical strengths may be bolstered for the application).

In order to effect the eccentric movement of pin 122, or of the connection point between the piston rod extension 140 and the piston rod 116 in general, the pin 122 may be replaced with a guide 146 (or the pin 122 may form a guide). If so provided, the guide 146 is preferably adapted to travel within a channel 148 (see FIG. 7) such that the channel controls the reciprocation of the piston rod extension 140 within the piston rod leg base 134. It will also be appreciated that a guide pin 146, separate and apart from the pin 122 may be provided. In such case, the guide pin 146 may generally be positioned anywhere along the length of the rod leg base 134 preferably, or on the piston rod extension 140, or even the piston rod 116. FIG. 5 depicts a guide 146 replacing a pin.

In order to allow for fitment of the engine components within the engine, it is preferred that the engine block be provided as two components, an upper block 100*a* and a lower block 100*b*. Referring to FIG. 4 momentarily, one will appreciate that the upper block 100*a* includes portions of the channels 148 and 156 while the lower block 100*b* includes the remaining portions.

Figure 6:
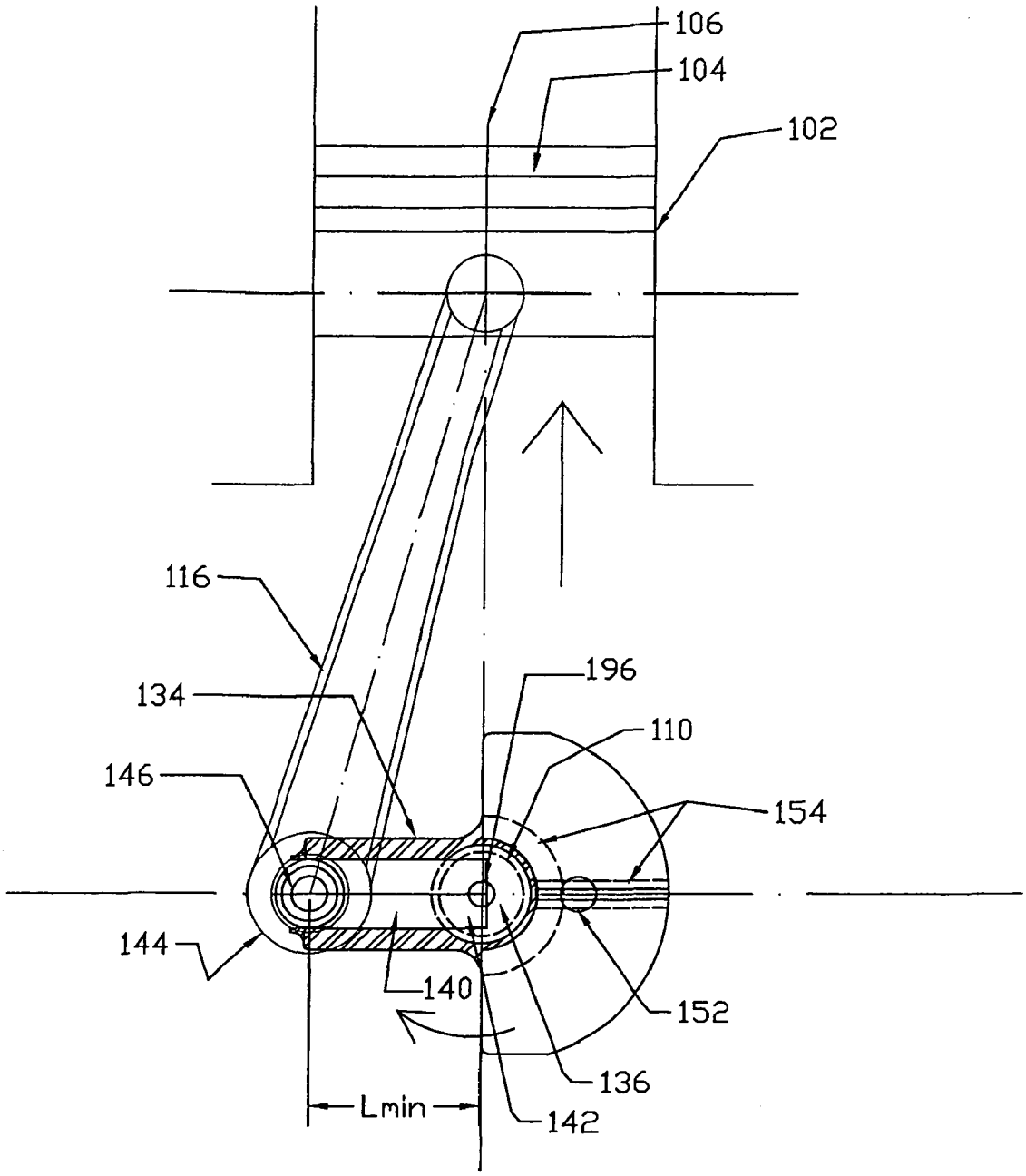
FIG. 6 is a partial cross-sectional view of the piston rod leg and associated components of FIG. 5, the piston rod leg in its shortest configuration at a position between BDC and TDC.

As shown in FIG. 5, when the piston 104 is approximately half way between TDC and BDC during the first and third strokes, the guide 146 may be configured to a length, $L_{max}$, which is the longest length of the combination piston rod leg base 134 and piston rod extension 140. However, at all other rotation angles, the combination may be shorter. For example, a shortest length, $L_{min}$, may be found and does not change while the piston 104 is performing its return travel from BDC to TDC, as shown in FIG. 6. In this regard, the piston rod extension 140 may be at a position significantly within the cavity 136 of the piston rod leg base 134. In addition, the $L_{min}$ length may occur and be found at other locations, such as precisely at TDC and BDC, as suggested by the path depicted in FIG. 4.

Still referring to FIG. 5, it will be appreciated that the counterweight 126 may also be provided with mechanisms permitting travel along an eccentric path, such as the eccentric path 132 shown in FIG. 4. Such mechanisms are substantially similar to those previously discussed with respect to the piston rod leg 114, and include a counter weight guide 152 which permits reciprocation of the counterweight along an extension member 154 (for example by virtue of pins extending from extension member 154 into channels embedded in the counterweight, not shown). The reciprocation may follow a channel 156 (see FIG. 7) located within the engine block 100 in a manner similar to that of channel 148 associated with the piston rod leg 114.

The counterweight preferably performs a reciprocating motion along its guide 152 which is inversely symmetrical to the eccentric path of the piston rod extension 140, offsetting any imbalance brought by the piston rod extension.

Figure 7:
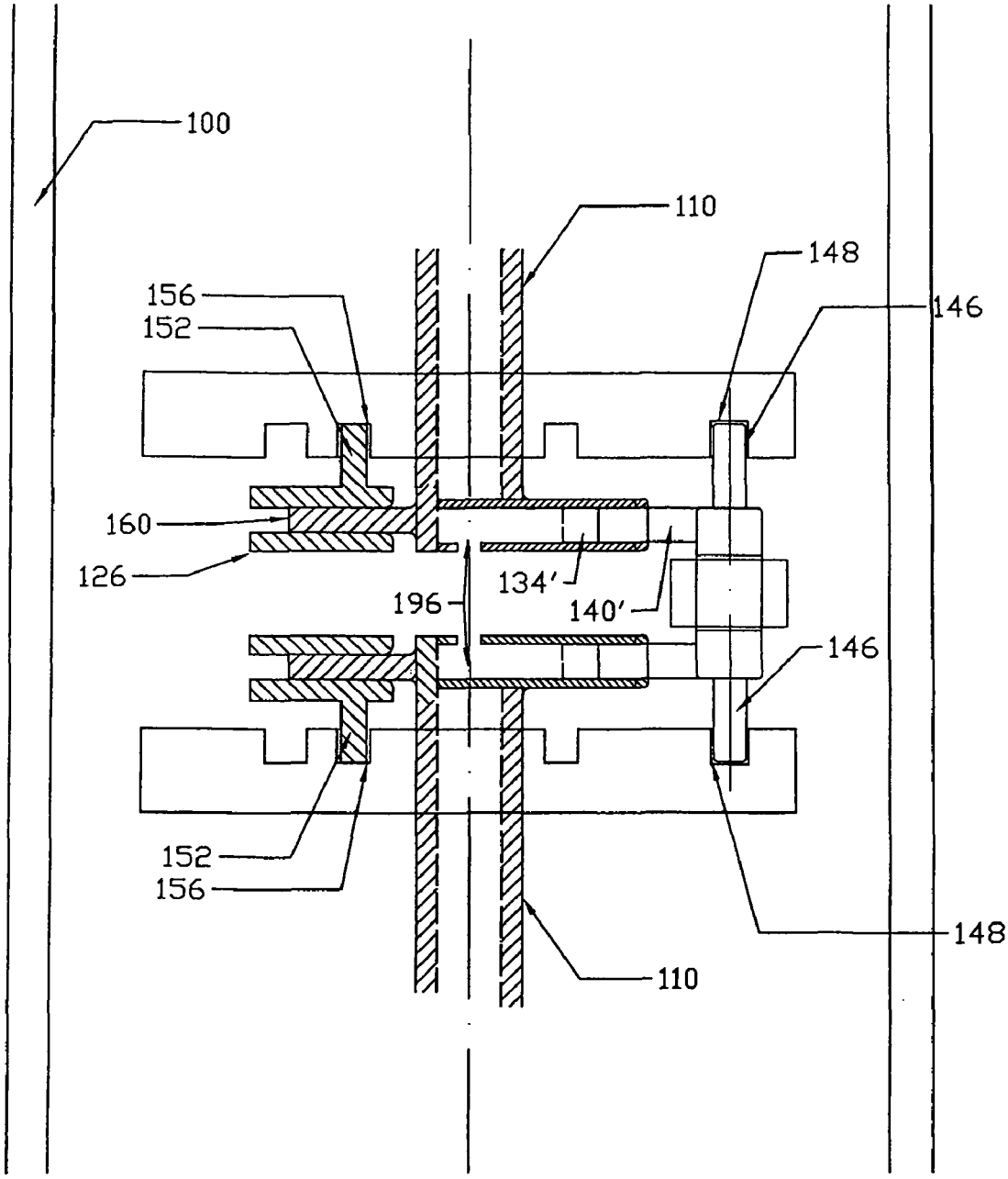
FIG. 7 is a section view of FIG. 5 at the shown section line, which is a horizontal cross section of the lower block of an engine with certain components in accordance with another embodiment of the present invention having twin piston rod legs.

The channels 148, 156 may be formed into the engine block 100 directly, or may be formed into one or more separate plates which are supported by the engine block 100. Shown in FIG. 7 is the plated arrangement, where engraved plates 158 and 160 are shown in engine block 100*b* (similar plates, not shown, may be embedded in engine block 100*a*). This "plated" design is preferable due to possible high forces and excessive wearing of the guide channels 148, 156 as such a design permits easy replacement of the channels from time to time. Such a replacement would typically involve taking down the oil pan and baffle plate while positioning all guides at the marrying point of top and bottom engraved plates, unscrewing the supports from the respective engine blocks, and replacing the guide engraved plates. This permits the installation of the guides 146 within the channels 148 as the plates may be placed within the lower block 100*a*. This may be followed by the upper block 100*b*, with plate, and an appropriate gasket, the upper block then being bolted in place to a predetermined torque setting in the conventional manner. It will be appreciated that the plates 158, 160 may be formed from the same material as the remainder of the engine block 100, or may be formed from different materials. Such different materials may have a greater resistance to wear for maximum effectiveness of the plates. Alternatively, or in addition, the plates may be coated with an anti-wear agent.

Figures 8, 9, 10:
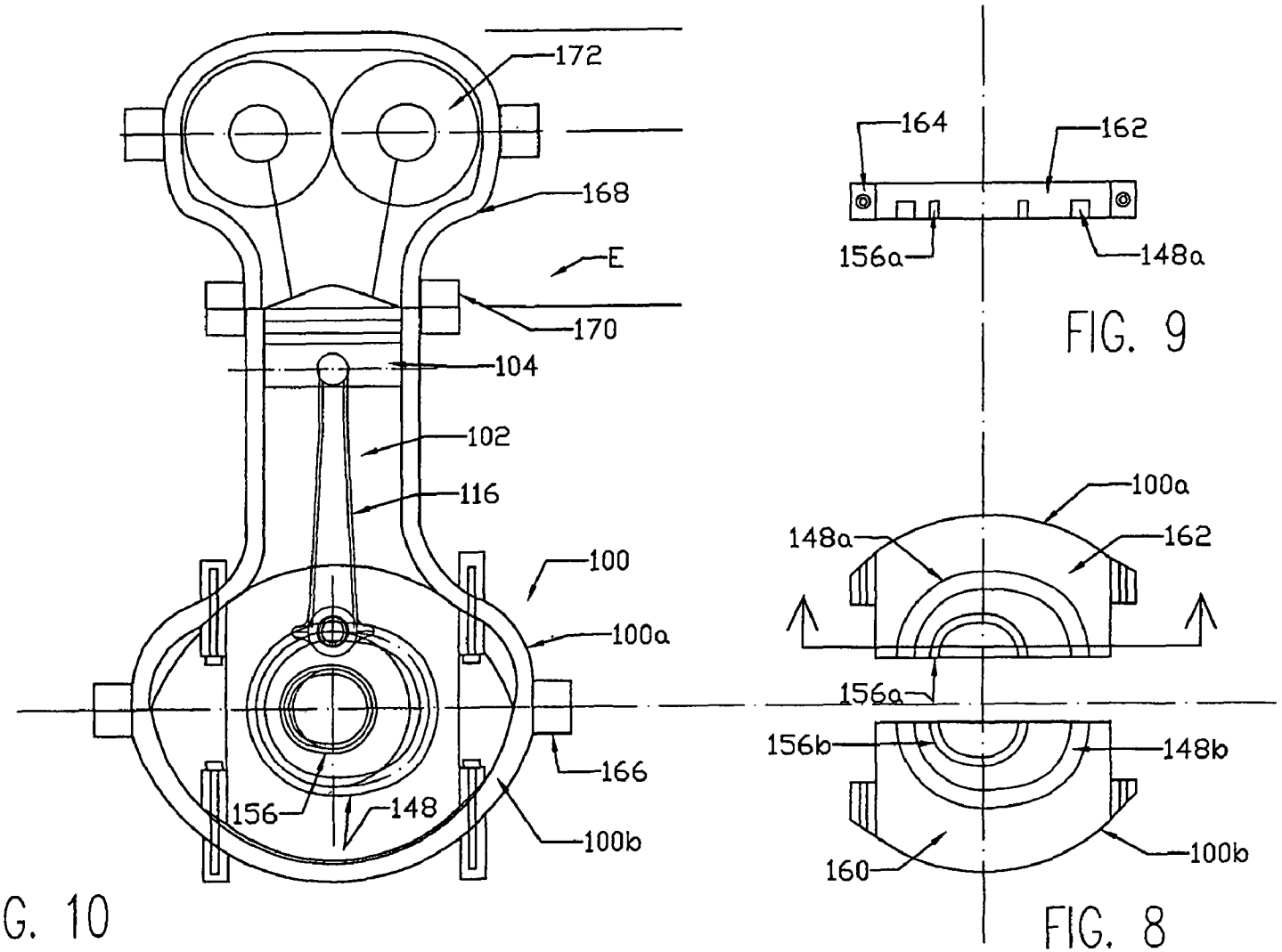
FIG. 8 is a side view of the detachable block containing the guide rails in accordance with an embodiment of the present invention. The view is looking from the center line of the piston to the block.
FIG. 9 is a cross-sectional view of the engine block of FIG. 8 at the shown section line; and, FIG. 10 is a partial schematic cross-sectional view of an exemplary engine.

FIG. 8 depicts a cross-sectional view of an engine block 100 in accordance with certain features of the invention. One may readily see that the engine block 100 may, such as in this embodiment, be configured from an upper block 100*a* and a lower engine block 100*b*. As shown in FIG. 8, the guide channel 148 for the guides 146 of the piston rod extension 140 may be split into an upper channel 148*a* and a lower channel 148*b*, the upper channel being wholly contained within the upper engine block 100*a* and the lower channel 148*b* being wholly contained within the lower engine block 100*b*. Likewise, the guide channel 156 for the counterweight 126 may be split into an upper channel 156*a* and a lower channel 156*b*, the upper channel being wholly contained within the upper engine block 100*a* and the lower channel being wholly contained within the lower engine block 100*b*. As discussed above, the guide channels 148, 156 may be formed directly into the engine block 100 or may be included on separate plates for ease of replacement and to enable other engineering options. In the embodiment shown in FIG. 8, the guide channels 148, 156 are shown as being part of plates 160, 162.

FIG. 9 depicts a cross-sectional view of plate 162 of FIG. 8. Shown in plate 162 are guide channels 148, 156, as previously discussed. In addition, the plate 162 may include mechanisms for attaching the plate to the upper engine block 100*a* such as bolts 164, shown in FIG. 9. Other mechanisms such as adhesives or other fastening means may also be utilized. However, no matter the means utilized, it is preferred that such means permit relatively routine replacement of the plate 162 from time to time. It will be appreciated that the remaining plates may be attached to the engine block 100 by the same or other means as plate 162.

Referring back to FIG. 7, one will appreciate that in other embodiments, the engine may include twin piston rod legs 134' and twin piston rod extensions 140'. It will be appreciated that such piston rod legs 134' and piston rod extensions 140' generally operate in the manner disclosed above, with the exception that there are a pair present instead of one. Such pairing may be beneficial for providing balance to the reciprocating engine. They may also be beneficial for permitting lighter weight components to be utilized without sacrificing overall strength.

In the embodiment of FIG. 7, there are twin piston rod extensions 140'. It will be appreciated that in further alternate embodiments, twin piston rod legs may be coupled with a single piston rod extension. In such case it is envisioned for optimal balance that the piston rod extension would generally be mounted in a position centered between said twin piston rod legs, although other configurations are possible.

It is well known that a motor oil bath lubricates the inner surfaces of a conventional engine. Likewise, the same oil bath may be utilized to lubricate the piston rod leg base 134 and the piston rod extension 140. It is understood that the reciprocating motion of piston rod extension 140 in the piston rod base 134 may create a positive air pressure in the hollow drive shaft, this should be neutralized due to the next piston's assembly performing the exact opposite motion. To do so, one may provide air derivation holes 196 (see FIG. 7) in the drive shaft for suction/discharge of air into the cavity around the drive shaft. Air derivation holes 196 at sides of piston rod leg bases will balance the air pressure caused by the reciprocating motion of piston rod extension in the cavity 136. Alternatively, air derivation holes 196 may be located in the hollow drive shaft itself. Also there may be a positive pressure oil pump provided. Preferably, the pump is powerful enough to drive the necessary amount of oil into the hollow crack shaft, which can later be driven into the reciprocating assemblies by the help of rotational forces. The guide and counterweight shall also preferably be lubricated by the same engine oil bath that provides lubrication for the other working components of the engine.

FIG. 10 depicts a partial schematic cross-sectional side view of a representative engine E in accordance with certain aspects of the present invention. It will be appreciated that the engine E comprises an engine block 100, inclusive of upper block 100*a* and lower block 100*b*, as previously discussed. Also included are the piston rod 116 and piston 104 within cylinder 102. The upper block 100*a* and lower block 100*b* may be connected to each other by a connection mechanism, such as a bolted mechanism 166 as is conventional. Similarly, the upper block 100*a* may be attached to a head unit 168 by a connection mechanism, such as a bolted mechanism 170, as is conventional. One will appreciate that within the head unit 168, there may be valve mechanisms 172 that act in conjunction with the reciprocating engine to achieve the aforementioned stroke cycles.

Also shown are representative eccentric paths along channels 148, 156.

Generally, it will be appreciated that the components of the half cycle eccentric crank-shafted engine are contemplated as being manufactured from materials which are the same as those used in conventional engines currently in manufacture, inclusive of standard metals as well as more elaborate materials such as titanium and ceramic.

With the foregoing teachings in mind, it will be appreciated that the disclosure may be commissioned in gasoline, diesel, fuel oil, natural gas, LPG, methanol, ethanol, and hydrogen fuelled internal combustion engines, which are known today, and very likely in further technologies that may be discovered in the future. Moreover, the teachings may be utilized in any motor that is stationary or for vehicles on land, sea, or air. However, it is to be generally understood that such teachings may find particular use in relatively slowly reciprocating engines, such as those found in today's diesel engines used in large ships, trains, and trucks.

In practice, the eccentric path of the present invention is envisioned to find particular application where one half is substantially circular, such as shown in FIG. 4. Using a rectangular (Cartesian) coordinate system to define the paths, one can evaluate a sample eccentric path. In this first example, the following assumptions are made:

The conventional radius of the drive shaft is R.

The rotation of the engine is clockwise (CW).

TDC position is 0 drive shaft degrees (0 deg).

Combustion is started by the spark plug some 5 to 40 drive shaft degrees prior to TDC, depending on engine speed and load. Right after the drive shaft passes through the upper most point, the orbit of the piston rod pin resembles a third degree equation and the piston rod's radius starts to increase. At the 90 degree position of the crank, between TDC and BDC, the moment arm reaches its maximum value. This value is chosen in a relation to the radius.

Eccentric radius of the drive shaft is Re.

$$Re=R*(1+\text{percentage of eccentricity})$$

In a first example:

Let R=4 cm.

Percentage of eccentricity (% e)=25%. Percentage of eccentricity is a dimensionless variable that lets one view the maximum eccentric radius in terms of a main radius. Where % e equals 0, the conventional system is represented. Percentage of eccentricity can be as high as 200% or more, pending the design to overcome the possible disadvantages brought by effectively lengthening the piston rod and creating an eccentric path along which its connection point with the cylinder travels. These possible disadvantages include the possibility of increased engine vibrations due to imbalanced revolution of connecting rod, greater moment of inertia to the system, more buckling moment in the connecting rod, and enhanced levels of friction. Of course, it will be appreciated that efforts may be made alleviate such concerns, for example by sizing the weight and strength of components accordingly, or by restricting the revolutions per minute specification of the resulting engine. Continuing:

$$Re=4*(1+0.25)=5 \text{ cm}$$

Here, the moment arm at 90 degree position becomes 5 cm. As the piston passes through the 90 degree point, the moment arm starts to decrease to reach the radius amount at the 180 degree point. This design yields three important factors:

The moment arm assumes a length longer than 4 cm for the entire combustion stage, which actually yields a 40% forecasted effective increase in the output torque.

The moment arm maintains a length of exactly 4 cm for the compression stage, which does not deviate from the conventional system. Assuming the same amount of fuel mixture enters the combustion chamber in the inventive system and a conventional system, the compression resistance will remain the same.

The more the moment arm increases in length, the greater the distance traveled by the piston rod. Increase in radial distance translates into piston movement, by means of higher quarterly acceleration in the first quarter and deceleration for the second, as well. This will allow the gas to expand in a higher speed during combustion, which is an advantage at least for gasoline fueled engines because gasoline fuel burns more efficiently at higher combustion speeds, producing more heat and a quicker more even burn.

These three important factors lead to a cleaner burning and higher torque output than can be achieved with a similarly sized conventional engine. A fourth factor may also be considered. The process described in the present invention permits the piston to decelerate in the second quarter such that gas expansion rate also decelerates leaving a higher effective pressure to drive the piston in the second quarter.

Considering different percentages of eccentricity, a half cycle eccentric crank-shafted engine may produce the following torque levels in relation to a conventional type engine.

A 25% half cycle eccentric crank-shafted engine may produce 1.45 times more torque.

A 50% half cycle eccentric crank-shafted engine may produce 1.9 times more torque.

An 85% half cycle eccentric crank-shafted engine may produce 2.56 times more torque.

A 100% half cycle eccentric crank-shafted engine may produce 2.82 times more torque.

These results may vary due to configuration of the engine as being gasoline, diesel, or other fuel as burn rates vary.

However, no matter the burn rate, the half cycle eccentric crank-shafted engine disclosed herein provides a heretofore unknown advance in the engine arts.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An internal combustion engine comprising:

an engine block forming at least one cylinder with a central axis;

a piston adapted to reciprocate linearly within said at least one cylinder along said central axis between a top dead center position and a bottom dead center position;

a crank shaft assembly mounted within said engine block, said crank shaft assembly including a drive shaft with a drive shaft axis and a hollow piston rod leg base;

a piston rod extension associated with said piston rod leg base, the piston rod extension having a first end adapted to travel in a reciprocating manner from a retracted position to an extended position, the first end being further within said hollow piston rod leg base in said retracted position than in said extended position, and a second end exterior to said hollow piston rod leg base, said second end including a guide;

a piston rod having a first end pivotally connected to said piston and a second end pivotally connected to said second end of said piston rod extension;

a guide channel associated with said engine block, said guide channel eccentrically circumscribing said drive shaft axis;

whereby during rotation of said drive shaft, said piston reciprocates between its top dead center and bottom dead center positions, and said guide travels along said guide channel to influence said second end of said piston rod extension between its retracted position as the piston moves from a position substantially at top dead center to its extended position when said piston is approximately half way between its top dead center and bottom dead center positions.

2. The engine of claim 1, wherein the guide channel is arranged such that the piston rod extension is substantially in its retracted position at the piston's top dead center and bottom dead center positions.

3. The engine of claim 2, wherein the guide channel is arranged such that the piston rod extension is substantially in its retracted position as the piston travels from the bottom dead center position to the top dead center position.

4. The engine of claim 1, wherein the guide is a guide pin.

5. The engine of claim 1, wherein the guide is two guides and the guide channel is two guide channels.

6. The engine of claim 1, further comprising a counterweight.

7. The engine of claim 6, wherein the guide is a first guide and the channel is a first channel, the counterweight further comprising a second guide and the engine block further comprising a second guide channel, the second guide and second guide channel influencing movement of said counterweight.

8. The engine of claim 7, wherein said counterweight is connected to said drive shaft along a counterweight channel, the counterweight channel permitting the counterweight to shift from a first position relative to the drive shaft to a second position relative to the drive shaft, the center of mass of the counterweight being closer to the drive shaft in the first position than in the second position, the shaft being controlled by the second guide channel and second guide.

9. The engine of claim 8, wherein said counterweight moves between its first position and its second position to substantially offset any imbalance created by movement of said piston rod extension from its retracted position and its extended position or from its extended position to its retracted position.

10. The engine of claim 1, wherein the engine block is formed from at least two components.

11. The engine of claim 10, wherein the guide channel is formed partially within each of the at least two components.

12. The engine of claim 1, further comprising a plate attached to said engine block, wherein said guide channel is formed in said plate.

13. The engine of claim 12, wherein said plate is replaceable.

14. The engine of claim 1, wherein said hollow piston rod leg base and said piston rod extension form a telescoping assembly.

15. The engine of claim 1, further comprising an air derivation hole associated with said hollow piston rod leg base.

16. The crank shaft assembly of claim 1, wherein the longitudinal axis of the drive shaft intersects with the central axis of the cylinder.

17. The crank shaft assembly of claim 1, wherein a central axis of guide channel intersects with the central axis of the cylinder.

18. An internal combustion engine comprising:

an engine block forming a cylinder with a central axis;

a piston adapted to reciprocate linearly within said cylinder along said central axis between a top dead center position and a bottom dead center position;

a crank shaft assembly mounted within said engine block, said crank shaft assembly including a drive shaft with a drive shaft axis and a piston rod leg base;

a piston rod extension associated with said piston rod leg base, the piston rod extension having a first end adapted to travel in a reciprocating manner from a retracted position to an extended position, the first end being closer to said drive shaft in said retracted position than in said extended position, and a second end exterior to said piston rod leg base, said second end including a guide;

a piston rod having a first end pivotally connected to said piston and a second end pivotally connected to said second end of said piston rod extension;

a guide channel associated with said engine block, said guide channel eccentrically circumscribing said drive shaft axis;

whereby during rotation of said drive shaft, said piston reciprocates between its top dead center and bottom dead center positions, said guide traveling along said guide channel to influence the piston rod extension between its retracted position as the piston moves from a position substantially at top dead center to its extended position when said piston is approximately half way between its top dead center and bottom dead center positions.

19. The engine of claim 18, wherein said piston rod leg base is a pair of piston rod legs.

20. The engine of claim 19, wherein said piston rod extension reciprocates between said pair of piston rod legs.

21. The engine of claim 18, wherein said guide is a pair of guide pins and said guide channel is a pair of guide channels, said guides adapted to fit within said guide channels.

22. The engine of claim 18, further comprising an air derivation hole associated with said piston rod leg base.

23. A crank shaft assembly, said crank shaft assembly comprising:

a drive shaft with a drive shaft axis and a hollow piston rod leg base;

a piston rod extension associated with said piston rod leg base, the piston rod extension having a first end adapted to travel in a reciprocating manner from a retracted position to an extended position, the first end being further within said hollow piston rod leg base in said retracted position than in said extended position, and a second end exterior to said hollow piston rod leg base;

wherein the drive shaft is adapted for use in an engine such that said drive shaft may rotate about said drive shaft axis and, the second end of said piston rod extension, when attached to a piston through a piston rod, may cause the piston to reciprocate within the engine as the piston rod extension goes from the retracted position to the extended position and back to the retracted position.

24. The crank shaft assembly of claim 18, further comprising a counterweight.

* * * * *